10/22/85 OR 4,548,358

United States Patent [19]

Fischer

[11] Patent Number: 4,548,358

[45] Date of Patent: Oct. 22, 1985

[54] MULTIPLE PIECE CUTTING TIP

[76] Inventor: Robert A. Fischer, 1903 Ave. C., Katy, Tex. 77449

[21] Appl. No.: 546,029

[22] Filed: Oct. 27, 1983

[51] Int. Cl.[4] ..... B05B 1/34

[52] U.S. Cl. ..... 239/424

[58] Field of Search ..... 239/424, 424.5, 489, 239/419.3, 552, 589, 600, 601, 434.5, 400, 404

[56] References Cited

U.S. PATENT DOCUMENTS

| | | | |
|---|---|---|---|
| 3,627,204 | 12/1971 | Stand | 239/424 |
| 3,750,958 | 8/1973 | Haselmann | 239/424.5 |
| 3,928,084 | 12/1975 | Etter | 239/424 |
| 4,014,469 | 3/1977 | Sato | 239/424 |
| 4,200,235 | 4/1980 | Monschke | 239/424.5 |
| 4,314,672 | 2/1982 | Madewell et al. | 239/424 |

*Primary Examiner*—James B. Marbert

*Attorney, Agent, or Firm*—Fulbright & Jaworski

[57] ABSTRACT

A multiple piece cutting tip for a cutting torch. An outer body with an inner body coaxially positioned therein forms a first passageway therebetween for transmitting preheat fuel and oxygen. A helical mixer in the first passageway more completely mixes the fuel and the oxygen. The first passageway includes a plurality of openings about the inner body at the tip end of the first passageway for preheating. The inner body includes a second passageway therethrough for the passage of cutting oxygen and the inner body includes a connection for changing the cross-sectional area of the second passageway. Radially extending ribs are provided about the outside of the outer body adjacent the tip for dissipating heat. The size of the second passageway may be modified by an elongate tubular member adapted to be threaded into the inner body and telescopically extend into the second passageway for changing the size of the second passageway.

5 Claims, 3 Drawing Figures

2
2
10
12
14
16
20
22
24
30
32
34
36
36a
36b
40
42
44
46
48
52
56
56b
57
57b

MULTIPLE PIECE CUTTING TIP

BACKGROUND OF THE INVENTION

Multiple piece torch tips for cutting torches are disclosed in U.S. Pat. Nos. 4,200,235 and 4,314,672.

The present invention is directed to an improved cutting tip which is multi-purpose, provides an increased mixing action for the oxygen and fuel preheater, increases the heat dissipation, is faster cutting, easier to clean, has a longer tip life, but is economical.

SUMMARY

It is an object of the present invention to provide a multiple piece cutting torch tip for attachment to the head of a cutting torch which includes an outer body, and an inner body coaxially positioned in the outer body and forming a first passageway positioned between the inner and outer bodies for transmitting preheat fuel and oxygen therethrough.

A still further object of the present invention is the provision of a helical mixer positioned in the first passageway for more completely mixing the fuel and oxygen and mixing various types of gaseous fuels and oxygen more thoroughly.

Yet a further object of the present invention is wherein the first passageway includes a plurality of openings about the inner body at the tip end of the first passageway for preheating. Preferably, the preheat openings are straight openings parallel to each other and of a sufficient cross section to produce longer flame stingers for allowing faster preheating for cutting. The openings may be of different sizes and shapes to accommodate different types of gaseous fuels.

Yet a still further object of the present invention is wherein the inner body includes a second passageway therethrough for the passage of cutting oxygen and means are provided connected to the inner body for adjusting the cross-sectional area of the second passageway for changing the volume of the supply of the cutting oxygen as desired. The adjusting means may include an elongate tubular body adapted to be threaded into the inner body and telescopically extend into the second passageway for varying the size of the second passageway.

Still a further object of the present invention is the provision of radially extending ribs about the outside of the outer body adjacent the tip for dissipating heat from the tip.

Yet a still further object of the present invention is wherein the helical mixer includes a plurality of holes in the leading helix to more thoroughly mix the fuel and oxygen for providing an increased turbulence to provide a more homogeneous mixture of the gaseous fuels before combustion.

Other and further objects, features and advantages will be apparent from the following description of presently preferred embodiments of the invention, given for the purpose of disclosure and taken in conjunction with the accompanying drawing.

DESCRIPTION OF THE PREFERRED EMBODIMENTS

Figures 1, 2, 3:
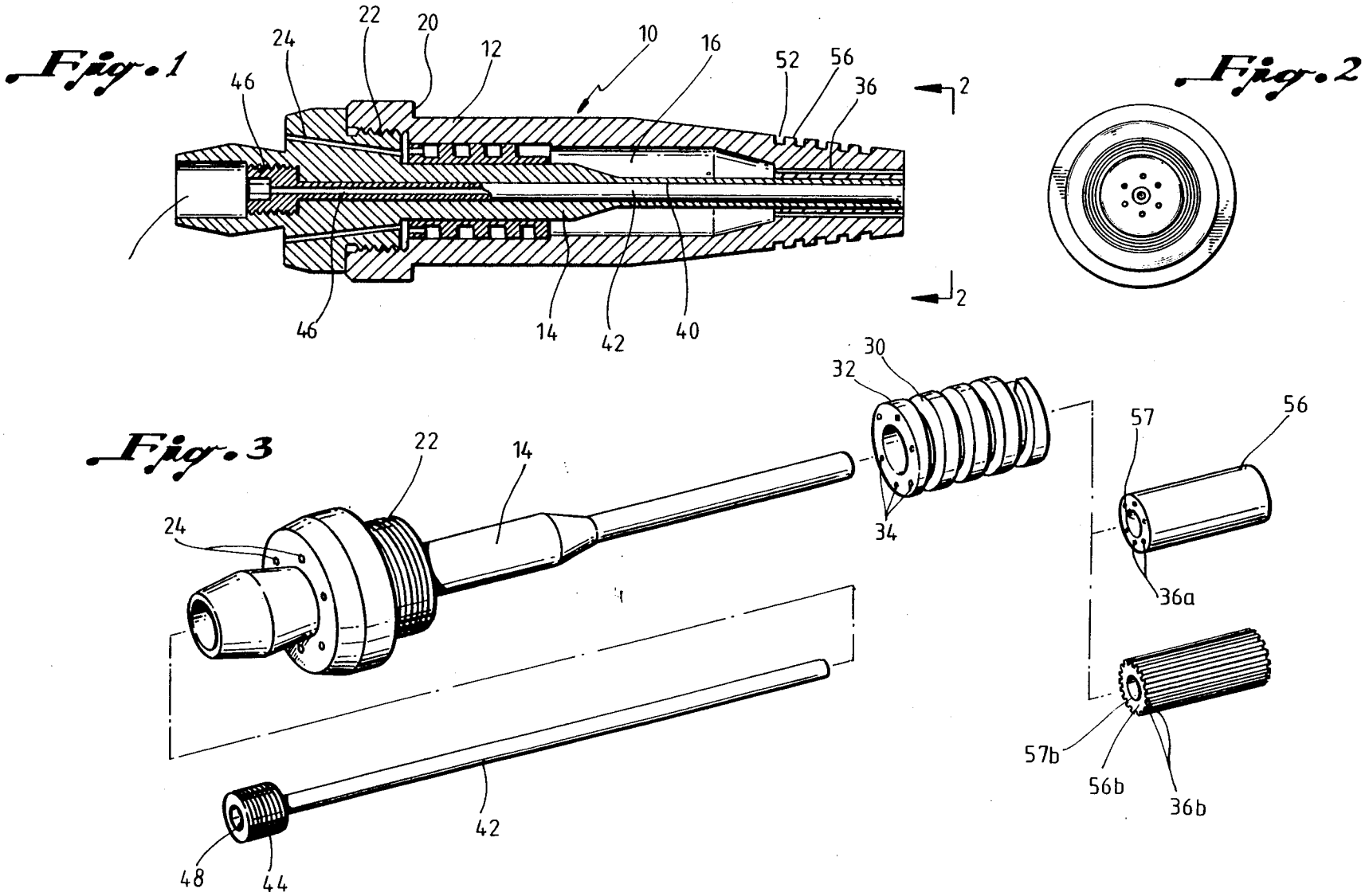
FIG. 1 is an elevational view, in cross section, of the cutting tip of the present invention.
FIG. 2 is a cross-sectional view taken along the line 2—2 of FIG. 1.
FIG. 3 is an isometric exploded view of the interior components of the cutting tip of the present invention with additional modifications.

The present invention is useful in various types of cutting torches and cutting attachments.

Referring now to the drawing, the reference numeral 10 generally indicates the multi-purpose and adjustable cutting tip of the present invention and generally includes an outer body 12 and an inner body 14. The inner body 14 is coaxially positioned in the interior of the outer body 12 and forms a first passageway 16 between the outer body 12 and the inner body 14 for transmitting preheat fuel and oxygen therethrough. The outer body 12 includes a flange 20 for conventionally securing the tip 10 to a conventional cutting head (not shown) of a conventional cutting torch. Preferably, the outer body 12 and inner body 14 are secured together by a coacting threaded connection 22 whereby the parts may be easily secured, but also disassembled for cleaning the various parts. The inner body 14 includes a plurality of ports 24 for receiving gaseous fuel and oxygen for transmittal to the first passageway 16.

Referring now to FIGS. 1 and 3, a helical mixer 30 is positioned in the first passageway 16 between the outer body 12 and the inner body 14 for mixing all types of gaseous fuels and oxygen more thoroughly and completely in order to improve the combustion of the preheat flame. Preferably, the leading helix 32 includes a plurality of holes 34 whereby the incoming mixture flows through the holes 34 for more thoroughly creating a turbulence and a complete homogeneous mixture of the gaseous fuel and oxygen before combustion.

The helical mixer 30 is removable from the outer and inner bodies 12 and 14 for cleaning by disconnecting the threaded connection 22.

The first passageway 16 includes a plurality of openings 36 about the inner body 14 at the tip end of the cutting tip 10 for preheating. In the preferred embodiment of FIG. 1, the openings 36 are provided by drilling the tip end of the outer body 12. Preferably, the openings 36 are parallel to each other and parallel to the axis of the inner body 14 to provide straight bores of a sufficient size to provide extended length stingers of flame allowing faster preheating for cutting.

The inner body 14 includes a second passageway 40 therethrough for the passage of cutting oxygen. Generally, a plurality of different cutting tips 10 have been used in the past having different size passageways 40 for selecting the desired size and volume of cutting oxygen to be used in a particular application. However, the present invention provides means connected to the inner body 14 for changing or adjusting the cross-sectional area of the second passageway 40 as may be desired. In the present invention, an elongate tubular member 42 is provided having a threaded connection 44 which is adapted to be threadably connected to threads 46 in the inner body 14 while the elongate tubular body 42 is adapted to telescopically extend into the second passageway 40 and change its size. The adapter 42 includes a passageway 46 therethrough of a different size than the second passageway 40 and various size adapters 42 may be used having various size passageways 46 for providing the desired size for the amount of cutting oxygen that is desired. The tubular body 42 may be easily and quickly inserted and removed from the inner body 14 by threading it and unthreading it therefrom by use of a conventional Allen head wrench in the opening 48.

At the tip end of the cutting tip 10 a plurality of ribs and grooves 50 and 52 are provided on the exterior of the body 12 adjacent the preheat holes 36 to dissipate heat from the tip end of the cutting tip 10. This allows the tip end to cool more rapidly, accumulates less heat, and provides a longer life for the tip 10.

As indicated in connection with FIG. 1, it is preferable that the preheat holes 36 be integral with the outer body 12. However, if desired, as best seen in FIG. 3, an insert 56 may be provided which can be secured to the body 12 by any suitable means such as wedging into the tip end of the body 12. The insert 56 is provided with a plurality of preheat holes **36*a* and an opening 57 for telescopically receiving the inner body 14. As a further embodiment, an insert 56*b* may be provided which is provided with a plurality of parallel extending slots 36*b* on the exterior of the insert 56*a* for conducting the preheat fuel and oxygen. Again, the insert 56*a* may be suitably secured to the interior tip end of the tip 10 such as by wedging and includes an interior opening 57*b* for accommodating the inner body 14. The insert 56*b* with its greater number of slots 36*b* with larger sizes than holes 36*a* handles a greater volume of preheat gas capacity and is particularly suitable for lower pressure gases for butane and propane. The insert 56, as is the embodiment of FIG. 1**, handles a lesser volume of preheat gas capacity, and is more suitable for gases such as acetelylene.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts will be readily apparent to those skilled in the art and which are encompassed within the spirit of the invention and the scope of the appended claims.

What is claimed is:

1. A cutting tip for attachment to the head of a cutting torch comprising, an outer body, an inner body coaxially positioned in the outer body and forming a first passageway positioned between the inner and outer bodies for transmitting preheat fuel and oxygen therethrough, a helical mixer positioned in the first passageway for more completely mixing the fuel and oxygen, said first passageway including a plurality of openings about the inner body at the tip end of the first passageway for preheating, said inner body having a second passageway therethrough for the passage of cutting oxygen, and releasable and replaceable adapter means connected to and extending into the inner body for adjusting the cross-sectional area of the second passageway.

2. The apparatus of claim 1 including, radially extending ribs about the outside of the outer body adjacent the tip for dissipating heat from the tip.

3. The apparatus of claim 1 wherein the adjusting means include, an elongate tubular body adapted to be threaded into the inner body and telescopically extends into the second passageway.

4. The apparatus of claim 1 wherein the helical mixer includes a plurality of holes in the leading helix to more thoroughly mix the fuel and oxygen.

5. The apparatus of claim 1 wherein the plurality of openings about the inner body are formed by slots extending around an insert which is positioned in the tip end of the first passageway.

* * * * *